United States Patent [19]

Fortier

[11] 4,408,537

[45] Oct. 11, 1983

[54] LASER-GUIDED BOMB TRAINER

[75] Inventor: Michel Fortier, Ste-Foy, Canada

[73] Assignee: Her Majesty the Queen in right of Canada, as represented by the Minister of National Defence, Quebec, Canada

[21] Appl. No.: 283,333

[22] Filed: Jul. 14, 1981

[30] Foreign Application Priority Data

Nov. 21, 1980 [CA] Canada ..... 365272

[51] Int. Cl.[3] ..... F42B 25/18

[52] U.S. Cl. ..... 102/395

[58] Field of Search ..... 102/395, 384, 382; 244/3.16

[56] References Cited

U.S. PATENT DOCUMENTS

| | | | |
|---|---|---|---|
| 2,502,442 | 4/1950 | Driskell | 102/395 |
| 3,343,486 | 9/1967 | Patrick | 102/395 |
| 4,112,843 | 9/1978 | Laviolette | 102/395 |

*Primary Examiner*—Charles T. Jordan

*Attorney, Agent, or Firm*—Stevens, Davis, Miller & Mosher

[57] ABSTRACT

A practice bomb designed to train air crews for use of laser-guided bombs. The practice bomb has an approximately similar ballistic coefficient to that of a laser-guided bomb. A laser seeker is fixed to the body of the practice bomb within its nose section. The laser seeker has means to provide an internal signal upon target acquisition. A smoke cartridge is secured in the practice bomb to release a smoke producing chemical to the atmosphere when activated, and appropriate means are associated with the laser seeker and smoke cartridge to activate the smoke cartridge upon receipt of the internal signal from the laser seeker. Such device provides a low-cost trainer which can be used to develop some of the skills required from air crews for delivery of laser-guided bombs.

4 Claims, 3 Drawing Figures

LGBT OPERATION

LASER-GUIDED BOMB TRAINER

BACKGROUND OF THE INVENTION

The present invention relates to a practice bomb for use as a laser-guided bomb trainer.

At the present time several countries have armed their aircraft with laser-guided bombs. Such bombs can be dropped with nearly pinpoint precision thus producing a significant increase in tactical bombing accuracy. Essentially a laser beam is reflected off the target and the laser-guided bomb receives reflected laser pulses through a gimbaled laser seeker system mounted on its nose. The direction of the receipt of the laser pulse is determined by the laser seeker and activates appropriate guidance fins, as required, to place the laser-guided bomb on target.

One of the problems of training air crews with laser-guided bombs is the expense of these bombs. Such laser-guided bombs, because of their guidance systems and the relative sophistication of their constructions, are a significant cost in laser-guided bomb training.

It is therefore an object of the present invention to provide a training device for laser-guided bombs which can significantly reduce the cost of laser-guided bomb training.

SUMMARY OF THE INVENTION

This invention relates to a practice bomb designed to train air crews for use of laser-guided bombs. The practice bomb has an approximately similar ballistic coefficient to that of a laser-guided bomb. A laser seeker is fixed to the body of the practice bomb within its nose section. The laser seeker has means to provide an internal signal upon target acquisition. A smoke cartridge is secured in the practice bomb to release a smoke producing chemical to the atmosphere when activated, and appropriate means are associated with the laser seeker and smoke cartridge to activate the smoke cartridge upon receipt of the internal signal from the laser seeker.

Such device provides a low-cost trainer which can be used to develop some of the skills required from air crews for delivery of laser-guided bombs.

BRIEF DESCRIPTION OF THE DRAWINGS

Other objects and advantages of the invention will become apparent upon reading the following detailed description and upon referring to the drawings in which.

While the invention will be described in connection with specific example embodiments thereof, it will be understood that it is not intended to limit the invention to those embodiments. On the contrary it is intended to cover all alternatives, modifications and equivalents as may be included within the spirit and scope of the invention as defined by the appended claims.

DETAILED DESCRIPTION OF THE INVENTION

Figure 1:
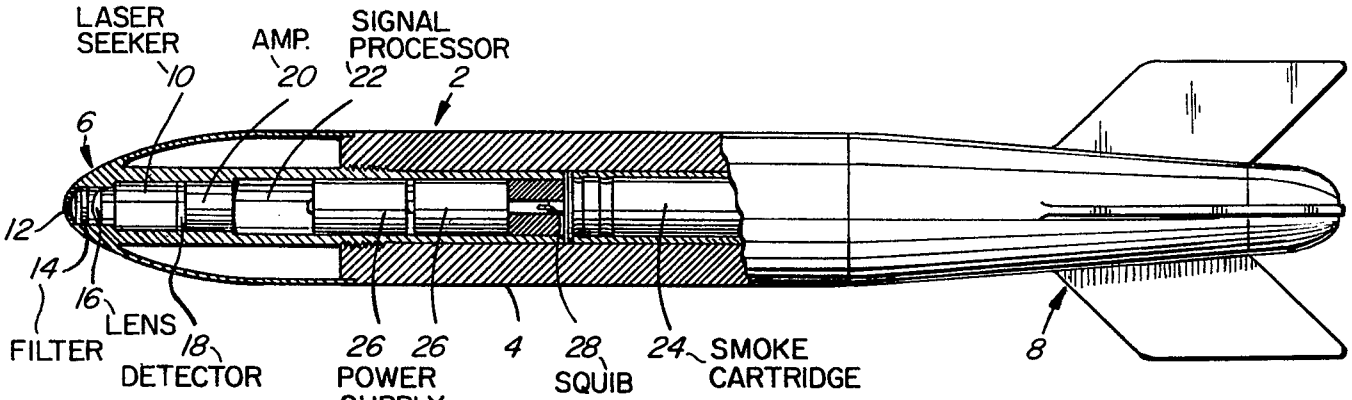
FIG. 1 is a side view in partial section of a laser-guided bomb trainer according to the present invention.

Turning first to FIG. 1, there is shown a laser-guided bomb trainer 2 according to the present invention, the device being housed in the body of a practice bomb 4 having an approximately similar ballistic coefficient to that of a laser-guided bomb. Practice bomb 4 has a nose section 6 and tail section 8 and a laser seeker 10 being fixed to the body of the practice bomb within its nose section and shielded by windowed protective dome 12. The laser seeker 10 comprises filter 14 to block ambient light sources while permitting passage therethrough of light of the predetermined range of wave lengths. An optical filter having a narrow band pass is desired so that most of the noise caused by the laser seeker responding to ambient light is eliminated.

The laser seeker should have the same field of view and acquisition range as the laser guided bomb. Light passed through filter 14 is focused by lens 16 on detector 18, which is a low cost single-segment detector, for example a diode. When illuminated with light of a predetermined wave length or range of wave lengths and appropriate intensity, the detector generates current which is amplified at amplifier 20 and passed to signal processor 22 electrically associated therewith where it is converted to a signal which will activate smoke cartridge 24. As illustrated in FIG. 1, activation of smoke cartridge 24 is accomplished by the signal from processor 22 activating power supply 26 which in turn causes a firing means, being squib 28, associated with the smoke cartridge to ignite.

OPERATION

Figure 2A:
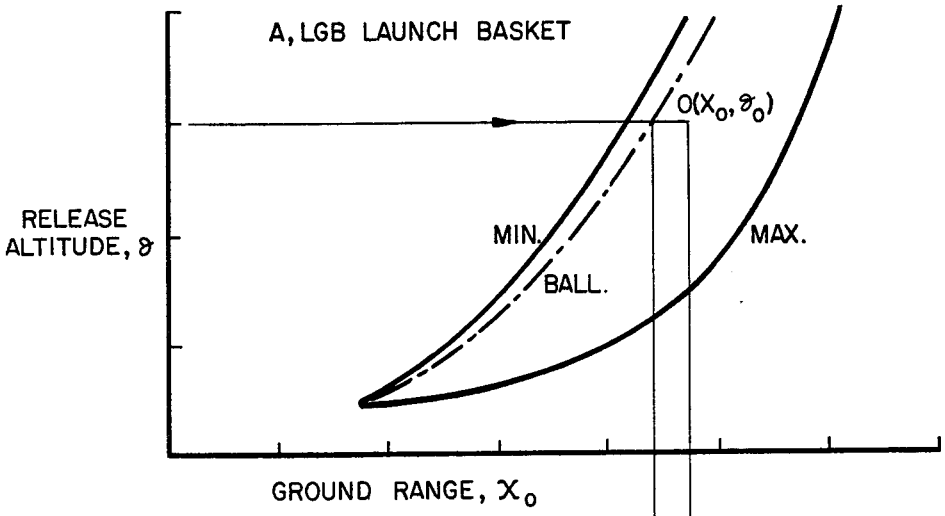
FIGS. 2*a* and 2*b* are graphs representing the likely sequence of events for employment of a laser-guided bomb trainer according to the present invention.
Figure 2B:
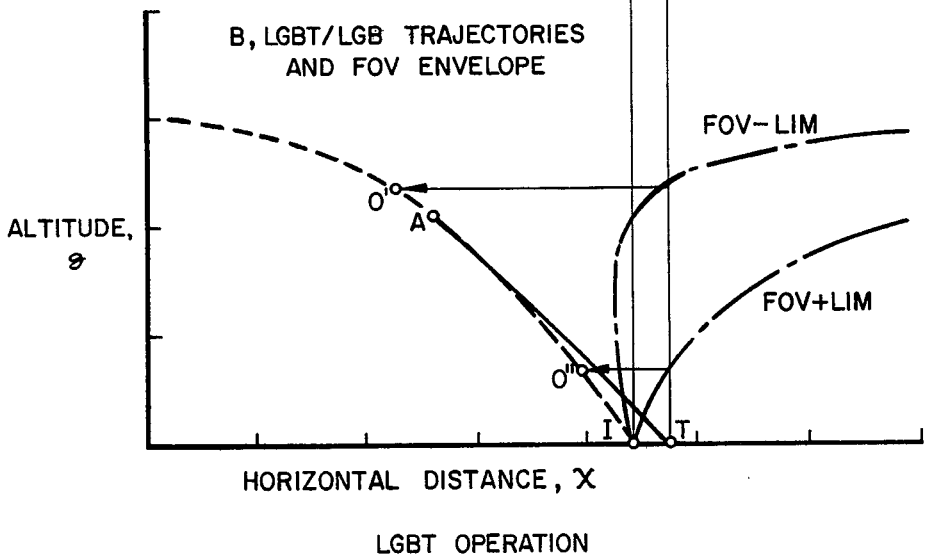

The likely sequence of events for employment of the laser-guided bomb trainer is described in FIG. 2. The laser-guided bomb trainer could be released from any point within a laser-guided bomb launch basket which is a function of the aircraft altitude and speed at the time of release, as shown in Part-A of FIG. 2. The left-hand side of the basket gives the minimum range at which the bomb can be released from a given altitude and the right-hand side gives the maximum. A release point O, defined by the release altitude $Z_O$ and ground range $X_O$, would be selected for an attack against a ground target T illuminated by a laser designator. The designator would be located on the bomber aircraft, on another aircraft assigned to the designation task or on the ground. After launch, the laser-guided bomb trainer would follow a ballistic trajectory similar to that of the laser-guided bomb until the level of laser energy reflected by the target is high enough to be picked up by the laser-guided bomb trainer detector. At this point A of target acquisition, shown in Part-B of FIG. 2, the laser-guided bomb trainer signal processor would send a command to a squib or firing mechanism which would activate the smoke cartridge. The cartridge would then release a chemical which would react with the atmosphere to produce a trail of smoke. The smoke would be spotted by the aircrew or a ground observer. The spotting of smoke would indicate that the target had been designated correctly and that the practice bomb had been delivered within the limits of the laser-guided bomb launch basket. Therefore, while the laser-guided bomb trainer would continue to fall ballistically until impact I, it could be deduced that if a laser-guided bomb had been delivered in the same manner as the laser-guided bomb trainer, it would have followed a guided flight path from acquisition A to target T.

As shown in Part-B of FIG. 2, for acquisition of target T to occur, point A has to fall on the segment O′ O″ of the ballistic trajectory. If atmospheric conditions are such that the acquisiton distance AT is too short so that point A falls below O″, the target is outside the field of vision and acquisition cannot occur. In such a case, the laser-guided bomb trainer would not release any smoke. This would indicate, correctly so, that a laser-guided bomb delivered in the same manner would not guide to the target. The laser-guided bomb trainer could then be used at first to exercise the aircrew skills required to deliver laser-guided bombs within launch boundaries.

It will be understood that the unit cost of a laser-guided bomb trainer is significantly lower than that of a laser-guided bomb because a guidance system, including control actuation means is not required, because a single-segment detector is used instead of multi-quadrant detectors, with a consequent simplification of the signal processor required (e.g. only one amplifier is required instead of four) and because the seeker is not gimbaled. From the above description it will be clear that the use of a laser-guided bomb trainer can significantly reduce the cost of laser-guided bomb training.

Thus it is apparent that there has been provided in accordance with the invention a laser-guided bomb trainer which fully satisfies the objects, aims and advantages set forth above. While the invention has been described in conjunction with a specific embodiment thereof it is evident that many alternatives, modifications and variations will be apparent to those skilled in the art in light of the foregoing description. Accordingly it is intended to embrace all such alternatives, modifications and variations as fall within the spirit and broad scope of the appended claims.

I claim:

1. For use as a laser-guided bomb trainer, a practice bomb having an approximately similar ballistic coefficient to that of a laser-guided bomb, the practice bomb having a nose and tail section; a laser seeker being fixed to the body of the practice bomb within its nose section and having means to provide an internal signal upon target acquisition; a smoke cartridge being secured in the practice bomb to release a smoke producing chemical to the atmosphere when activated; and means associated with the laser seeker and smoke cartridge to activate the smoke cartridge upon receipt of the internal signal from the laser seeker.

2. A laser-guided bomb trainer according to claim 1, wherein the laser seeker comprises a filter to block ambient light sources, a lens, a single segment detector, the lens to focus collected, filtered light on the detector, the detector to generate current when illuminated with light of a predetermined wave length or range of wave lengths and predetermined intensity, an amplifier electrically associated with the detector to receive and amplify current generated thereby, and a signal processor electrically associated with the amplifier to convert a signal received from the amplifier to one which will activate the smoke cartridge.

3. A laser-guided bomb trainer according to claim 2, further comprising a power supply actuable upon receipt of the converted signal from the signal processor to ignite a firing means associated with the smoke cartridge and thereby activate the smoke cartridge.

4. A laser-guided bomb trainer according to claim 1, 2 or 3, wherein the laser seeker is shielded by a windowed protective dome in the nose section of the practice bomb.

* * * * *